United States Patent [19]

Dessau

[11] Patent Number: 4,652,360

[45] Date of Patent: Mar. 24, 1987

[54] BASE-EXCHANGED ZEOLITE COMPOSITIONS WITH SHAPE-SELECTIVE METAL FUNCTIONS

[75] Inventor: Ralph M. Dessau, Edison, N.J.

[73] Assignee: Mobil Oil Corporation, New York, N.Y.

[21] Appl. No.: 896,296

[22] Filed: Aug. 12, 1986

Related U.S. Application Data

[60] Continuation of Ser. No. 757,195, Jul. 22, 1985, abandoned, which is a continuation of Ser. No. 630,176, Jul. 12, 1984, abandoned, which is a division of Ser. No. 391,209, Jun. 23, 1982, abandoned.

[51] Int. Cl.[4] ..... C10G 35/06

[52] U.S. Cl. ..... 208/138; 208/137; 585/415; 585/419

[58] Field of Search ..... 208/138, 137; 585/415, 585/419

[56] References Cited

U.S. PATENT DOCUMENTS

| | | | |
|---|---|---|---|
| Re. 28,341 | 2/1975 | Wadlinger et al. | 208/120 |
| 3,130,007 | 4/1964 | Breck | 23/113 |
| 3,308,069 | 3/1967 | Wadlinger et al. | 252/455 |
| 4,097,367 | 6/1978 | Haag et al. | 208/138 |
| 4,285,919 | 8/1981 | Klotz | 423/277 |
| 4,299,686 | 11/1981 | Kuehl | 208/138 |
| 4,327,236 | 4/1982 | Klotz | 585/481 |
| 4,331,641 | 5/1982 | Hinnenkamp et al. | 423/277 |
| 4,347,394 | 8/1982 | Detz et al. | 585/419 |
| 4,417,083 | 11/1983 | Bernard et al. | 585/419 |
| 4,435,283 | 3/1984 | Buss et al. | 208/138 |
| 4,443,326 | 4/1984 | Field | 208/138 |
| 4,447,316 | 5/1984 | Buss | 585/419 |

FOREIGN PATENT DOCUMENTS

| | | |
|---|---|---|
| 2024790 | 1/1980 | United Kingdom . |
| 2033358 | 5/1980 | United Kingdom . |

*Primary Examiner*—William R. Dixon, Jr.
*Assistant Examiner*—Cynthia A. Prezlock
*Attorney, Agent, or Firm*—Alexander J. McKillop; Michael G. Gilman; Dennis P. Santini

[57] ABSTRACT

This invention provides a novel base-exchanged shape-selective hydrogenation-dehydrogenation-dehydrocyclization catalyst composition which is a zeolite matrix having a silica-alumina ratio of at least 12, and having a shape-selective functioning intrazeolitic Group VIII metal content between about 0.01–10 weight percent.

The zeolite catalyst is adapted for efficient shape-selective metal function hydrogenolysis, dehydrogenation and aromatization conversion of hydrocarbon mixtures, with a minimized acid-catalyzed cracking activity.

23 Claims, No Drawings

BASE-EXCHANGED ZEOLITE COMPOSITIONS WITH SHAPE-SELECTIVE METAL FUNCTIONS

CROSS-REFERENCE TO RELATED APPLICATION

This is a continuation of copending application Ser. No. 757,195 filed July 22, 1985 and abandoned which is a continuation of Ser. No. 630,176 filed 7-12-84 and now abandoned which is a division of applicaion Ser. No. 391,209 filed June 23, 1982 now abandoned.

BACKGROUND OF THE INVENTION

Natural and synthetic zeolitic materials have been demonstrated to have catalytic properties for various types of hydrocarbon conversion. Certain zeolitic materials are ordered porous crystalline aluminosilicates having a definite crystalline structure as determined by X-ray diffraction, within which there are a large number of smaller cavities which may be interconnected by a number of still smaller channels or pores. These cavities and pores are uniform in size within a specific zeolitic material. Since the dimensions of these pores are such as to accept molecules of certain dimensions while rejecting those of larger dimensions, these materials have come to be known as "molecular sieves" and are utilized in a variety of ways to take advantage of these properties.

Such molecular sieves include a wide variety of positive ion-containing crystalline aluminosilicates. These aluminosilicates can be described as a rigid three-dimensional framework of $SiO_4$ and $AlO_4$ in which the tetrahedra are crosslinked by the sharing of oxygen atoms whereby the ratio of the total aluminum and silicon atoms to oxygen atoms is 1:2. The electrovalence of the tetrahedra containing aluminum is balanced by the inclusion in the crystal of a cation, for example an alkali metal or an alkaline earth metal cation. This can be expressed in a manner such that the ratio of aluminum to the number of various cations, such as Ca/2, Sr/2, Na, K or Li, is equal to unity. One type of cation may be exchanged either entirely or partially with another type of cation utilizing ion exchange techniques in a conventional manner. By means of such cation exchange, it has been possible to vary the properties of a given aluminosilicate by suitable selection of the cation. The spaces between the tetrahedra are occupied by molecules of water prior to dehydration.

Prior art techniques have resulted in the formation of a great variety of synthetic aluminosilicates. These aluminosilicates have come to be designated by letter or other convenient symbols, as illustrated by zeolite A (U.S. Pat. No. 2,882,243), zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), zeolite ZSM-5 (U.S. Pat. No. 3,702,886), zeolite ZSM-11 (U.S. Pat. No. 3,709,979), zeolite ZSM-12 (U.S. Pat. No. 3,832,449), zeolite ZSM-20 (U.S. Pat. No. 3,972,983), ZSM-35 (U.S. Pat. No. 4,016,245), zeolites ZSM-21 and ZSM-38 (U.S. Pat. No. 4,046,859), zeolite ZSM-23 (U.S. Pat. No. 4,076,842), and the like.

The $SiO_2/Al_2O_3$ ratio of a given zeolite is often variable. For example, zeolite X can be synthesized with $SiO_2/Al_2O_3$ ratios of from 2 to 3; zeolite Y, from 3 to about 6. In some zeolites, the upper limit of $SiO_2/Al_2O_3$ ratio is essentially unlimited. ZSM-5 is one such example in which the $SiO_2Al_2O_3$ ratio can vary from about 5 up to a ratio which approaches infinity. U.S. Pat. No. 3,941,871 (now U.S. Pat. Re. No. 29,948) discloses a porous crystalline silicate made from a reaction mixture containing no deliberately added alumina in the formulation and exhibiting an X-ray diffraction pattern characteristic of ZSM-5 type zeolites. U.S. Pat. Nos. 4,061,724; 4,073,865; and 4,104,294 describe crystalline silicates or organosilicates of varying alumina and metal content.

The prior art also discloses methods for incorporating into zeolitic materials strong hydrogenation-dehydrogenation metal components as illustrated by metals such as molybdenum, chromium and vanadium, and Group VIII metals such as cobalt, nickel and palladium.

U.S. Pat. No. 3,201,356 describes a method for activating a crystalline zeolitic molecular sieve catalyst composited with a noble metal component which involves dehydrating said catalyst to a water content of less than 1.8 weight percent at a temperature below 320° F., and thereafter heating the catalyst in the presence of hydrogen at a temperature of about 320° F.

U.S. Pat. No. 3,700,585 in columns 7-8 reviews the typical ion exchange techniques employed for introducing metal cations into zeolite structures, such as the techniques described in U.S. Pat. Nos. 3,140,249; 3,140,251; and 3,140,253. As a general procedure, a particular zeolite is contacted with a salt solution of the desired replacing cation. The zeolite is then preferably washed with water, dried at 65°-315° C., and calcined in inert atmosphere at 260°-815° C.

U.S. Pat. No. 3,956,104 describes a hydrocracking catalyst which is prepared by a series of steps which include (1) admixing ammonium hydroxide and aluminum sulfate in an aqueous medium to form a soluble aluminum sulfate partial hydrolysis product; (2) admixing a crystalline aluminosilicate zeolite with the partial hydrolysis product, effecting complete hydrolysis of the aluminum sulfate, and ageing the resulting mixture for about two hours; (3) separating and washing the solids; and (4) impregnating the solids with calculated quantities of Group VIB and Group VIII metal components, and calcining the resulting composite.

U.S. Pat. No. 4,148,713 describes the preparation of ZSM-5 type of crystalline aluminosilicate zeolites which have particles coated with an aluminum-free outer shell of silica. Optionally the zeolites can contain metal cations of hydrogenation components such as Group VI and Group VIII metals.

U.S. Pat. No. 4,174,272 describes zeolite catalysts containing platinum group metals, which are employed in non-hydrogenative endothermic catalytic cracking of hydrocarbons in a system wherein the endothermic heat required for cracking is supplied by the catalyst as the heat transfer medium.

The prior art crystalline aluminosilicate zeolites of the type described above generally exhibit acid activity, in their hydrogen form, e.g., they have a relatively low silica/alumina ratio. Acidity and ion-exchange capacity are related to the aluminum content of a zeolite. A high silica/alumina zeolite exhibits relatively low acid activity in the hydrogen form.

The shape-selective properties of the prior art zeolites are adapted for acid-catalyzed reactions such as cracking of hydrocarbons. The said prior art zeolites are not particularly effective for shape-selective metal-catalyzed reactions such as shape-selective dehydrogenation and dehydrocyclization, e.g., for the conversion of n-paraffins to aromatic products in the presence of cycloparaffins.

Accordingly, it is an object of this invention to provide a method for preparing a crystalline zeolite catalyst composition which contains a shape-selective metal function, and which exhibits a reduced acid activity.

It is another object of this invention to provide a base-exchanged crystalline zeolite composition which exhibits an X-ray diffraction pattern characteristic of a ZSM-5 or ZSM-11 type of zeolite structure, which has a high capacity for ion-exchanging metal cations, and which contains a shape-selective metal function and exhibits little or no acid-catalyzed reactivity.

It is a further object of this invention to provide a process for the production of aromatic hydrocarbons from paraffinic feedstock in the presence of a base-exchanged crystalline zeolite catalyst containing a shape-selective metal function, wherein the catalyst has an ultra-high silica/alumina ratio and exhibits an X-ray diffraction pattern characteristic of a ZSM-5 or ZSM-11 type of zeolite structure.

Other objects and advantages of the present invention shall become apparent from the accompanying description and examples.

DESCRIPTION OF THE INVENTION

One or more objects of the present invention are accomplished by the provision of a method of preparing a shape-selective zeolite catalyst composition of reduced acidity which comprises (1) subjecting assynthesized crystalline zeolite material having a silica/ alumina ratio of at least 12 to calcination at a temperature between about 200°–600° C. for a period between about 1–48 hours; (2) contacting the calcined zeolite with an aqueous solution of Group VIII metal compound to exchange or sorb ionic Group VIII metal into the zeolite; (3) thermally treating the Group VIII metal-containing zeolite at a temperature in the range between about 150°–550° C.; and (4) base-exchanging the zeolite substrate with Group IA metal cations to lower or essentially eliminate the base-exchangeable acidic content of the catalyst composition.

The as-synthesized crystalline zeolite material in step(1) is preferably selected from zeolites which exhibit an X-ray diffraction pattern characteristic of a ZSM-5 or ZSM-11 type of aluminosilicate structure as disclosed in U.S. Pat. Nos. 3,702,886 and 3,709,979, incorporated herein by reference. ZSM-5 type zeolites are known to have a constraint index of from about 1 to about 12, non-limiting examples of which include ZSM-5, ZSM-11, ZSM-12, ZSM-35 and ZSM-38.

For example, ZSM-5 zeolites possess a definite distinguishing crystalline structure whose X-ray diffraction pattern is characterized by the following significant lines:

| Interplanar spacing d(A): | Relative intensity* |
|---|---|
| 11.1 ± 0.2 | S |
| 10.0 ± 0.2 | S |
| 7.4 ± 0.15 | W |
| 7.1 ± 0.15 | W |
| 6.3 ± 0.1 | W |
| 6.04 ± 0.1 | W |
| 5.97 ± 0.1 | W |
| 5.56 ± 0.1 | W |
| 5.01 ± 0.1 | W |
| 4.60 ± 0.08 | W |
| 4.25 ± 0.08 | W |
| 3.85 ± 0.07 | VS |

-continued

| Interplanar spacing d(A): | Relative intensity* |
|---|---|
| 3.71 ± 0.05 | S |
| 3.64 ± 0.05 | M |
| 3.04 ± 0.03 | W |
| 2.99 ± 0.02 | W |
| 2.94 ± 0.02 | W |

*S = strong, M = medium, VS = very strong, W = weak.

A ZSM-5 type of zeolite composition can be prepared utilizing materials which supply the appropriate oxides. Such compositions include sodium aluminate, alumina, sodium silicate, silica hydrosol, silica gel, silicic acid, sodium hydroxide and tetrapropylammonium hydroxide. Each oxide component utilized in the reaction mixture for preparing a member of the ZSM-5 family can be supplied by one or more initial reactants and they can be mixed together in any order. For example, sodium oxide can be supplied by an aqueous solution of sodium hydroxide, or by an aqueous solution of sodium silicate; tetrapropylammonium cation can be supplied by the bromide salt. The reaction mixture can be prepared either batchwise or continuously.

Referring again to the present invention catalyst preparation method as recited above, the as-synthesized crystalline zeolite material is calcined in step(1) prior to the incorporation of the Group VIII metal component (and any other additional metal component) in the subsequent step(2).

The calcined zeolite material is then contacted in step(2) with an aqueous solution of at least one Group VIII metal salt to exchange or sorb ionic Group VIII metal into the zeolite. The preferred Group VIII metals are platinum and palladium. Illustrative of suitable platinum compounds are chloroplatinic acid, platinous chloride, platinum amine complexes, and the like.

Following the slurry contact of the zeolite material with the aqueous solution of Group VIII metal compound, the zeolite material normally is washed with water and dried at a temperature of about 110° C.

The Group VIII metal is incorporated in the intrazeolitic matrix in a quantity between about 0.01–10 weight percent, and preferably in a quantity between about 0.1–5 weight percent.

In step(3) of the catalyst preparation method, the thermal treatment of the Group VIII metal-containing zeolite is accomplished by heating the zeolite substrate in contact with a reducing or oxidizing or inert environment. For example, the environment can be air, hydrogen, olefinically-unsaturated hydrocarbon, nitrogen, or the like.

The step(3) thermal treatment is conducted at a temperature in the range between about 150°–550° C., for a period of time sufficient to achieve the desired conversion state, e.g., a contact time between about 0.2–2 hours.

When an olefinically-unsaturated hydrocarbon reducing agent is employed in the thermal treatment, it is selected from acyclic and cyclic mono- and polyunsaturated $C_3$–$C_{20}$ alkenes and alkynes. The preferred olefinically-unsaturated hydrocarbons are acyclic and cyclic $C_3$–$C_{12}$ mono-unsaturated alkenes.

Illustrative of suitable olefinically-unsaturated hydrocarbons are propene, 2-methylpropene, butene, butadiene, pentene, pentadiene, hexene, heptene, octadiene, dodecene, propyne, hexyne, cyclopentene, cyclopentadiene, cyclohexene, vinylcyclohexene, cycloheptene, and the like.

After the step(3) thermal treatment of the Group VIII metal-containing zeolite is completed, it is an essential aspect of the present invention method of catalyst preparation that the metal-containing zeolite is then base-exchanged in step(4) with an ionic Group IA metal. The base-exchange with Group IA metallic cations such as lithium, sodium, potassium or cesium is for the purpose of reducing the acidity of the Group VIII metal-containing zeolite substrate, e.g., the acidic sites generated during the step(3) thermal treatment.

The base-exchange can be accomplished by slurrying the zeolite in an aqueous solution of a suitable Group IA compound such as sodium hydroxide, potassium chloride, cesium hydroxide and the like. As desired, the base-exchange can be achieved to a lesser or greater degree. For example, the base-exchange can be accomplished under selected conditions of reagent concentration, pH, contact time, and the like, so as to eliminate substantially the base-exchangeable acidic content. Such a base-exchanged Group VIII metal-containing zeolite is essentially "non-acidic", and exhibits substantially no acid-catalyzed reactivity when employed as a catalyst in hydrocarbon conversion systems. The base-exchanged zeolite can be recovered from the base-exchange medium and dried in a conventional manner.

In one of its embodiments, the present invention provides a base-exchanged shape-selective hydrogenation-dehydrogenation-dehydrocyclization zeolite catalyst composition which has a silica alumina ratio of at least 500, a shape-selective functioning intrazeolitic Group VIII metal content between about 0.01–10 weight percent, and exhibits substantially no acid-catalyzed reactivity. Preferably, the zeolite exhibits an X-ray diffraction pattern characteristic of ZSM-5 or ZSM-11 type of zeolite structure, and the Group VIII metal content is selected from platinum and palladium.

Crystalline Silica Compositions

As noted hereinabove, the present invention is concerned with crystalline high silica-containing zeolites which have a silica/alumina ratio of at least 500, and particularly zeolites in which the silica/alumina ratio is greater than 10,000, (i.e., approaches infinity). High silica-containing zeolites per se are known in the prior art, as exemplified by the disclosure of U.S. Pat. Nos. 3,941,871; 4,061,724; 4,073,865; and 4,104,294.

In one of its important embodiments, the present invention provides a base-exchanged catalyst composition comprising crystalline silica which exhibits an X-ray diffraction pattern characteristic of a ZSM-5 or ZSM-11 type of zeolite structure, and which contains between about 0.01–10 weight percent of intrazeolitic Group VIII metal. A present invention catalyst composition can also include up to about 10 weight percent of other elements such as boron, beryllium, gallium, and the like.

A preferred zeolite catalyst composition of the present invention is one comprising crystalline silica which exhibits an X-ray diffraction pattern characteristic of a ZSM-5 or ZSM-11 type of zeolite structure, which contains between about 0.01–10 weight percent of shape-selective functioning intrazeolitic Group VIII metal, and which is substantially free of base-exchangeable acidic content.

The term "intrazeolitic" as employed herein with respect to metal content refers to the metal contained within the internal cavities and channels and pores characteristic of a crystalline zeolite structure.

The term "zeolite" as employed herein is meant to include crystalline ultra-high silica aluminosilicate and crystalline silica compositions which exhibit an X-ray diffraction pattern characteristic of crystalline zeolites such as ZSM-5 and ZSM-11.

The term "acid-catalyzed reactivity" as employed herein refers to the catalytic effect exhibited by the acidic content of a zeolite composition in hydrocarbon conversion processes, e.g., cracking to low molecular products as illustrated in Example VIII.

A present invention high silica zeolite catalyst composition characteristically exhibits shape-selective hydrogenation, dehydrogenation and dehydrocyclization activities. The advantages of a present invention base-exchanged zeolite catalyst composition appear to be attributable mainly to the relative absence of acidic content, and also to the presence of Group VIII metal which is distributed within the intrazeolitic structure. The Group VIII metal is situated within the internal channels and pores of the crystalline zeolite. The intrazeolitic Group VIII metal is capable of catalyzing shape-selective hydrogenolysis, dehydrogenation and aromatization reactions of mixed hydrocarbon feeds.

Further, because of the intrazeolitic nature of the Group VIII metal content, a present invention zeolite catalyst composition exhibits increased resistance to bulky poisons (such as tri-p-tolylphosphine) and reduced ageing relative to other types of supported Group VIII metal catalyst compositions.

Although it is not fully understood, there appear to be at least two factors which account for the shape-selective Group VIII metal reactivity in the catalyst compositions.

First, the high silica zeolitic substrate in the calcined as-synthesized form has an unusual capability to ion-exchange Group VIII metal into the crystalline matrix. At least a severalfold excess of Group VIII metal cations can be incorporated in the zeolite, above that which is theoretically projected on the basis of the aluminum content of the zeolite. For example, when a ZSM-5 zeolite has a silica/alumina ratio of 600, the aluminum content is 0.05 millimoles per gram of zeolite. Yet, the excess ion-exchange capacity of the zeolitic substrate permits the incorporation of 0.38 milliequivalents of platinum per gram of zeolite, or 0.33 milliequivalents of palladium per gram of zeolite.

It is believed that the excess ion-exchange capacity of an ultra high silica zeolite may be a phenomenon attributable to the presence of ion-exchangeable silicate ions occluded within the intrazeolitic structure.

As a second factor which is important for the provision of shape-selective reactivity in the present invention zeolite catalyst compositions, it appears that the thermal treatment of the Group VIII metal-containing zeolite under the conditions described does not cause any substantial migration of the internally disposed metal atoms out of the intrazeolitic matrix to the crystalline surfaces. Externally situated metal atoms do not have shape-selective reactivity as required for the objects of the present invention.

The term "shape-selective metal function" as employed herein in one aspect refers to the ability of an invention zeolite composition to convert linear $C_6$–$C_{50}$ hydrocarbons to aromatics more readily than cyclic hydrocarbons convert to aromatics, i.e., with a linear/cyclic hydrocarbon conversion ratio of greater than 1.0.

A present invention zeolite catalyst composition exhibits shape-selective metal reactivity as distinct from shape-selective acid reactivity which is disclosed in the prior art.

A zeolite catalyst has a shape-selective metal function if it meets the following described reactivity standard.

An equimolar mixture of n-heptane and cyclohexane in a nitrogen stream is passed over a zeolite catalyst composition at 500° C. For purposes of the present invention, a zeolite catalyst composition has a shape-selective metal function under the test conditions if the conversion of n-heptane is greater than the conversion of cyclohexane, while the aromatic product derived from n-heptane exceeds the aromatic product derived from cyclohexane. This is illustrated in Table III, (Run 2), wherein the conversion of n-heptane is 85% and the conversion of cyclohexane is 15.3%, and the toluene derived from n-heptane exceeds the yield of benzene derived from cyclohexene.

Alternatively, a zeolite catalyst has a shape-selective metal function if it meets the following described reactivity standard.

An equimolar mixture of 1,2-dimethylcyclohexane and 1,4-dimethylcyclohexane in a hydrogen stream is passed over a zeolite catalyst composition at 350°–400° C. For purposes of the present invention, a zeolite catalyst composition has a shape-selective metal function under the test conditions if the molar ratio of p-xylene to o-xylene in the product is greater than 2.0 at less than 50 percent conversion of the 1,4-isomer.

Hydrocarbon Conversion

A present invention shape-selective crystalline high silica zeolite catalyst composition is effective for the hydrogenolysis of n-paraffins to lower molecular weight products, the dehydrogenation of paraffins, the dehydrocyclization and aromatization of hydrocarbons, the aromatization of naphthas, the upgrading of low-octane reformate, and the like.

Thus, in another embodiment the present invention provides a process for the production of aromatic hydrocarbons which comprises contacting $C_6$–$C_{50}$ hydrocarbon feedstock under reforming conditions with a base-exchanged shape-selective crystalline zeolite catalyst composition; wherein said catalyst is a zeolite having a silica-alumina ratio of at least 12, and having a shape-selective functioning intrazeolitic Group VIII metal content between about 0.01–10 weight percent.

Illustrative of Group VIII metals are platinum and palladium. A preferred zeolite catalyst composition is one containing platinum, either alone or in combination with one or more other Group VIII metals.

The $C_6$–$C_{50}$ hydrocarbon feedstock can comprise single components such as hexane, cyclohexene or decane, or it can comprise mixtures such as petroleum refinery distillates which contain both acyclic and cyclic alkane and alkene components. A preferred type of feedstock is one which contains at least 20 weight percent of acyclic hydrocarbons, and which does not contain more than a minor proportion of $C_1$–$C_5$ hydrocarbons.

Optimal efficiency is achieved when the process is operated continuously by passage of the $C_6$–$C_{50}$ hydrocarbon feedstock in vapor phase through a bed of zeolite catalyst in a reforming zone maintained at a temperature between about 375°–575° C. The pressure in the system can be subatmospheric, atmospheric or superatmospheric. The pressure normally will be in the range between about 50–500 psi.

The weight hourly space velocity (WHSV) of the hydrocarbon feedstock typically will be in the range between about 0.2–5.

The feedstream passing through the reforming zone can include a partial pressure of added hydrogen, although it is preferred not to include added hydrogen. It is highly advantageous to conduct the reforming reaction in the absence of added hydrogen, and particularly in the presence of an inert gas. The partial pressure of the added inert gas stream can vary in the range between 5–500 psi.

In the presence of an inert gas such as nitrogen or steam, the ratio of aromatics to hydrocracked paraffinic products increases and a high yield of hydrogen is obtained.

A particularly significant aspect of the present invention process described above is the dehydrogenation-dehydrocyclization which is effected by the novel type of shape-selective metal function zeolite catalyst of low acidity being employed. Thus, when a mixture of normal and branched chain paraffins are subjected to reforming, the normal paraffins are substantially converted while the branched chain paraffins remain substantially unconverted. As a further illustration, with a present invention shape-selective metal function zeolite catalyst composition 1,4-dialkylcyclohexane is preferentially dehydrogenated to the corresponding 1,4-dialkylbenzene with a severalfold selectivity factor in comparison to the dehydrogenation of 1,2-dialkylcyclohexane to 1,2-dialkylbenzene.

In another embodiment the present invention provides a process for upgrading a petroleum fraction which comprises contacting low octane reformate under reforming conditions with a base-exchanged shape-selective crystalline zeolite catalyst composition; wherein said catalyst is a zeolite having a silica-alumina ratio of at least 12, and having a shape-selective functioning intrazeolitic Group VIII metal content between about 0.01–10 weight percent.

In another embodiment the present invention provides a process for hydrogenolysis of hydrocarbons which comprises contacting a heated stream of paraffinic feedstock and hydrogen with a base-exchanged shape-selective crystalline zeolite catalyst composition; wherein said catalyst is a zeolite having a silica-alumina ratio of at least 12, and having a shape-selective functioning intrazeolitic Group VIII metal content between about 0.01–10 weight percent.

In another embodiment the present invention provides a process for dehydrogenation of hydrocarbons which comprises contacting a heated stream of paraffinic feedstock with a base-exchanged shape-selective crystalline zeolite catalyst composition; wherein said catalyst is a zeolite having a shape-selective functioning intrazeolitic Group VIII metal content between about 0.01–10 weight percent.

In a further embodiment the present invention provides a process for hydrogenation of hydrocarbons which comprises contacting a heated stream of olefinically unsaturated hydrocarbon feedstock and hydrogen with a base-exchanged shape-selective crystalline zeolite catalyst composition; wherein said catalyst is a zeolite having a silica-alumina ratio of at least 12, and having a shape-selective functioning intrazeolitic Group VIII metal content between about 0.01–10 weight percent.

The following examples are further illustrative of the present invention. The reactants and other specific ingredients are presented as being typical, and various modifications can be derived in view of the foregoing disclosure within the scope of the invention.

EXAMPLE I

This Example illustrates the preparation of a Group VIII metal-containing crystalline high silica/alumina ratio zeolite catalyst composition in accordance with the present invention.

An as-synthesized ZSM-5 zeolite is calcined in air to 538° C. at about 1.0° C. per minute rate, and maintained at 538° C. for about 10 hours. The silica-alumina of the as-synthesized zeolite is about 7000, and the sodium content is 0.42%.

A 3.0 gram quantity of calcined zeolite is slurried with a solution of 0.312 gram of $Pt(NH_3)_4Cl_2.H_2O$ in 300 milliliters of water for four hours at room temperature. The platinum-tetraamine exchanged zeolite is filtered and washed to yield a composition containing 0.110 meq N/gram ash, which is equivalent to 0.055 meq Pt/gram ash or 0.54% Pt content in the zeolite composition.

The platinum-containing zeolite is reduced in a stream of nitrogen and hexene-1, while the temperature is raised to 450° C. at 2° C. per minute.

As a final step, the reduced platinum-containing zeolite is slurried in 100 milliliters of 3% potassium hydroxide solution at room temperature, with intermittent stirring over a period of 10 hours. The base-exchanged zeolite is recovered, washed with water, and dried at 110° C.

EXAMPLE II

This Example illustrates the excess ion-exchange capacity of the present invention high silica zeolites.

In the manner of Example I, the group of zeolites listed in Table I are ion-exchanged with platinum by slurrying the calcined zeolite with a solution of $Pt(NH_3)_4Cl_2.H_2O$ in an aqueous medium at room temperature over a period of four hours.

As a reference point, a silica-alumina ratio of 500 is equivalent to 0.18 weight percent aluminum (1800 ppm of aluminum).

TABLE I

| Zeolite | Si/Al | Al, mm/g | Ion-exchange Capacity Pt, meg/g |
|---|---|---|---|
| ZSM-5 | 1670 | 0.02 | 0.25 |
| ZSM-5 | 26,000 | 0.001 | 0.42 |
| ZSM-11 | 1056 | 0.03 | 0.32 |

EXAMPLE III

This Example illustrates the application of present invention zeolite catalyst compositions (prepared as in Example I) to shape-selective conversions of various hydrocarbon mixtures.

The indicated cesium-containing catalysts are produced by the same procedure as Example I, except that the Group VIII metal-containing zeolite intermediate is back ion-exchanged with 100 milliliters of 3% cesium chloride solution after thermal treatment in air.

For the platinum-catalyzed conversion of n-paraffin, the reaction is conducted in a downflow glass reactor packed with about 2.0 grams of zeolite catalyst composition, at 400°–450° C. and atmospheric pressure. The paraffin is fed via a Sage Syringe pump at 0.4–1 WHSV in a flow of hydrogen ($H_2$/HC of 5–8). The reactor effluent is monitored by on-line vapor phase chromatography employing an OV101 capillary column. The reaction products are identified by GC-MS.

A. Shape-selective Hydrogenolysis

A mixture containing n-hexadecane, 2,6,10,14-tetramethylpentadecane (pristane) and hydrogen is passed over a Pt/ZSM-5 catalyst at 450° C. Shape-selective hydrogenolysis of the mixture is observed, as indicated by greater than 65% conversion of n-hexadecane and less than 10% conversion of the pristane (i.e., a selectivity factor greater than 10) to lower paraffins.

B. Shape-selective Dehydrogenation

An equimolar mixture of 1,2-dimethylcyclohexane and 1,4-dimethylcyclohexane in hydrogen is contacted at 350°–400° C. with the respective catalysts listed in Table II.

The present invention zeolite catalyst exhibits-shape-selective dehydrogenation to p-xylene while the conventional platinum on alumina catalyst does not.

C. Shape-selective Aromatization

An equimolar mixture of a normal paraffin and a cyclohexane in nitrogen is contacted at 500° C. with a present invention shape-selective cesium back ion-exchanged Pt/ZSM-5 catalyst (Runs 1–2).

The results in Table III indicate that preferential conversion of the normal paraffin component occurs. Also, listed in Table III are the results obtained (Runs 3–4) with a platinum-on-carbon catalyst which is not shape-selective in its reactivity.

TABLE II

| Catalyst | Selectivity(p/o-xylene) | T°C. | WHSV | % Conversion p-xylene | % Conversion o-xylene |
|---|---|---|---|---|---|
| 1.7% Pt/Cs-ZSM-5 | 11.1 | 365 | 1.7 | 79.3 | 13.2 |
| 0.5% $Pt/Al_2O_3$ (Engelhard) | 0.84 | 374 | 1.6 | 14.3 | 16.7 |

TABLE III

| Run | Feed | Weight Percent | Percent Conversion | Composition Of Product Effluent | Percent Of Total Effluent |
|---|---|---|---|---|---|
| 1 | $CH_3(CH_2)_4CH_3$ | 43.4 | 69 | → 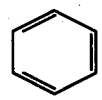 | 28.2 |

TABLE III-continued

| Run | Feed | Weight Percent | Percent Conversion | | Composition Of Product Effluent | Percent Of Total Effluent |
|---|---|---|---|---|---|---|
| | 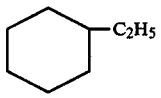 | 56.6 | 28 | → | 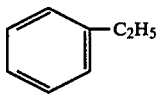 | 1.6 |
| 2 | $CH_3(CH_2)_5CH_3$ | 54.4 | 85 | → | 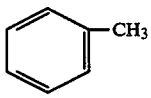 | 31.8 |
| | 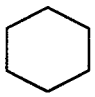 | 45.6 | 15.3 | → | 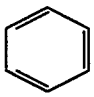 | 5.3 |
| 3 | $CH_3(CH_2)_4CH_3$ | 43.4 | 10.6 | → | 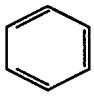 | 2.5 |
| | 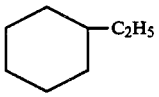 | 56.6 | 26 | → | 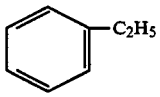 | 11.8 |
| 4 | $CH_3(CH_2)_5CH_3$ | 54.4 | 33 | → | 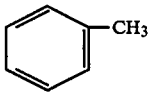 | 10.4 |
| | 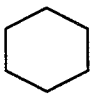 | 45.6 | 28.5 | → | 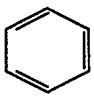 | 15.6 |

EXAMPLE IV

This Example illustrates the application of a present invention high silica zeolite catalyst composition (prepared as in Example I) for dewaxing-reforming of a petroleum fraction.

An Arab light distillate cut (400°–650° F.) is passed over a 0.54% Pt/ZSM-5 catalyst at 465° C. and 0.4 WHSV in a stream of hydrogen at atmospheric pressure.

GC-MS analysis of the liquid product indicates a decrease in paraffins and an increase in the aromatic to aliphatic carbon ratio from 0.15 to 0.22. The micro pour point of the recovered product (96% yield) is −42° C., as compared to -20° C. for the distillate feedstock.

EXAMPLE V

This Example illustrates the application of a present invention zeolite catalyst composition (prepared as in Example I) for dehydrogenation of a lower n-paraffin.

A stream of propane is passed over a Pt/ZSM-5 catalyst at 550°–575° C. and atmospheric pressure and with a WHSV of 1.3.

GC-MS analysis of the product effluent indicates a 30% conversion of propane, with an 85% selectivity to propylene.

The use of a present invention catalyst composition for purposes of n-paraffin dehydrogenation is advantageous in that it has superior ageing characteristics and therefore does not require frequent regeneration.

EXAMPLE VI

This Example illustrates the application of a present invention zeolite catalyst composition (prepared as in Example I) for reforming of hydrotreated naphtha.

$Pt(NH_3)_4Cl_2.H_2O$ is employed to ion-exchange a 26,000:1 $SiO_2$-$Al_2O_3$ ZSM-5 zeolite substrate. The platinum-containing zeolite is reduced with a stream of hexene-1 and nitrogen, while the temperature is raised at 1° C. per minute to 500° C. The final catalyst has a 1.5% platinum content after base-exchange with cesium chloride.

The naphtha feed is passed through 3.4 grams of the catalyst under the following conditions:

Naphtha feed rate, 2 ml/hr.
Hydrogen flow rate, 10 cc/min.
Reaction Temp., 500° C.
Atmospheric Pressure
Liquid Product collected at 0° C.
Liquid Recovery, 72 wt %.

The composition and RON of the naphtha feed and the reformed product are as follows:

| Weight, % | Naphtha Feed | Reformed Product |
|---|---|---|
| n-Hexane | 8.7 | 0.6 |
| n-Heptane | 9.1 | 1.2 |

-continued

| Weight, % | Naphtha Feed | Reformed Product |
|---|---|---|
| n-Octane | 7.9 | 1.4 |
| N—Nonane | 6.6 | 1.5 |
| Benzene | 0.6 | 13.7 |
| Toluene | 2.0 | 10.2 |
| RON (unleaded) | 38 | 81 |

EXAMPLE VII

This Example illustrates the application of a bimetallic form of a present invention zeolite catalyst composition for reforming of hydrotreated naphtha.

A ZSM-5 substrate is ion-exchanged with $Pt(NH_3)_4Cl.H_2O$ in the manner of Example VI, then the platinum-exchanged zeolite is impregnated with $H_2IrCl_4$ to yield a catalyst precursor which contains 1.4% platinum and 0.35% iridium. The catalyst is thermally treated in air, and then base-exchanged with sodium carbonate.

The hydrotreated naphtha feed is passed through the bimetallic zeolite catalyst at 530° C. and atmospheric pressure and with a WHSV of 2.

The composition and RON of the naphtha feed and reformed product are as follows:

| Weight, % | Naphtha Feed | Reformed Product |
|---|---|---|
| n-Hexane | 8.7 | 1.7 |
| n-Heptane | 9.1 | 1.6 |
| Benzene | 0.6 | 5.3 |
| Toluene | 2.0 | 8.3 |
| RON (unleaded) | 38 | 87 |

Similar results are obtained when the bimetallic components of the catalyst are 0.01–10 weight percent platinum and 0.01–5 weight percent rhodium, or 0.01–10 weight percent platinum and 0.01–5 weight percent rhenium.

EXAMPLE VIII

This Example illustrates a comparison between Group VIII metal-containing zeolite catalyst compositions, with and without base-exchange treatment, in hydrocarbon conversions.

A. Comparison Catalyst

A 26,000:1 $SiO_2/Al_2O_3$ as-synthesized ZSM-5 is calcined in nitrogen to 538° C. at 1° C./min, and again in air to 538° C.

The calcined zeolite is slurried in an aqueous solution of $Pt(NH_3)_4Cl_2.H_2O$ at room temperature for several hours, filtered, and washed to provide a ZSM-5 zeolite containing 3.6% Pt.

The Pt/ZSM-5 zeolite is then heated in an oxygen stream to 300° C. at a rate of 0.5° C./min, and maintained at 300° C. for one hour.

This catalyst exhibits shape-selective dehydrogenation of 1,4-dimethylcyclohexane relative to 1,2-dimethylcyclohexane. At 370° C., the ratio of p-xylene to o-xylene produced is greater than 10:1.

B. Base-exchanged Catalyst

Calcined Pt/ZSM-5 catalyst prepared as above is slurried in a solution of cesium hydroxide (pH 11.8) at room temperature for one hour, and is then filtered without washing. This base-exchanged zeolite in accordance with the present invention is compared with Catalyst A which has not been base-exchanged, with respect to acid-catalyzed reactivity in hydrocarbon conversions.

C. Olefin Hydrogenation

An equimolar mixture of hexene-1 and 4,4-dimethylhexene-1 in a hydrogen stream is contacted with the respective catalyst at a temperature of 300° C.

| Catalyst | % Cracking | % Hexene-1 Hydrogenated | % 4,4-Dimethylhexene Hydrogenated |
|---|---|---|---|
| A | 1.0 | 90.8 | 22.7 |
| B | <0.1 | 95.5 | 18.2 |

This comparison illustrates the lower acid-catalyzed cracking activity exhibited by a present invention base-exchanged Group VIII metal-containing zeolite catalyst composition.

The term "base-exchanged" as employed herein refers to a zeolite substrate which has had its acidic content reduced by ion-exchange with Group IA metal cations subsequent to the inclusion of a Group VIIIA metal and subsequent to thermal treatment of the Group VIIIA metal-containing zeolite substrate.

EXAMPLE IX

This Example illustrates a comparison between Group VIII metal-containing zeolite catalyst compositions, with and without base-exchange treatment, in n-hexane dehydrocyclization.

The aromatization reaction is conducted at 465° C. in a nitrogen stream.

Catalyst A and Catalyst B are those described in Example VIII. Catalyst C is prepared in a similar manner, and is not base-exchanged, while Catalyst D is a cesium base-exchanged Pt/ZSM-5 in accordance with the present invention.

| Catalyst | $Si/O_2$ | % Selectivity To Benzene |
|---|---|---|
| A | 26,000 | 58 |
| B (base-exchanged) | 26,000 | 86 |
| C | 70 | 5 |
| D (base-exchanged) | 70 | 60 |

The present invention Catalyst B above is effective for achieving greater than 99% conversion of n-hexane with an 86% selectivity to benzene. The present invention Catalyst D also is a superior catalyst for the n-hexane aromatization reaction, in comparison with Catalyst C which has not been base-exchanged in accordance with the present invention.

What is claimed is:

1. A process for the production of aromatic hydrocarbons which comprises contacting C6-C50 hydrocarbon feedstock under reforming conditions with a base-exchanged shape-selective crystalline zeolite catalyst compositions; wherein said catalyst is a zeolite having a silica/alumina ratio of at least 12 and having a shape-selective functioning intrazeolitic Group VIII metal content between about 0.01–10 weight percent, and wherein said catalyst is prepared by a process which comprises (1) subjecting as-synthesized crystalline zeolite material having a silica/alumina ratio of at least 12 to calcination at a temperature between about 200°–600° C. for a period between about 1–48 hours; (2) contacting the calcined zeolite with an aqueous solution of Group VIII metal compound to exchange or sorb ionic Group VIII metal into the zeolite; (3) thermally treating the Group VIII metal-containing zeolite at a temperature in the range between about 150°-550° C.; and (4) bae exchanging the zeolite substrate with Group IA metal cations to lower or essentially eliminate the base-exchangeable acidic content of the catalyst composition.

2. A process in accordance with claim 1 wherein the catalyst exhibits substantially no acid-catalyzed reactivity.

3. A process in accordance with claim 1 wherein the hydrocarbon feedstock comprises at least 20 weight percent of acyclic hydrocarbons.

4. A process in accordance with claim 1 wherein the reforming temperature is in the range between about 375°-575° C.

5. A process in accordance with claim 1 wherein the WHSV of the hydrocarbon feedstock through the reforming zone is in the range between about 0.2-5.

6. A process in accordance with claim 1 wherein the reforming reaction is conducted in the presence of added hydrogen.

7. A process in accordance with claim 1 wherein the reforming reaction is conducted in the presence of an inert gas.

8. A process in accordance with claim 1 wherein the catalyst composition exhibits an X-ray diffraction pattern characteristic of a ZSM-5 zeolite structure.

9. A process in accordance with claim 1 wherein the catalyst composition exhibits an X-ray diffraction pattern characteristic of a ZSM-11 zeolite structure.

10. A process in accordance with claim 1 wherein the Group VIII metal in the catalyst composition comprises platinum.

11. A process in accordance with claim 1 wherein the Group VIII metal in the catalyst composition comprises palladium.

12. A process in accordance with claim 1 wherein the Group VIII metal in the catalyst composition comprises platinum and at least one other Group VIII metal

13. A process in accordance with claim 1 wherein the Group VIII metal in the catalyst composition comprises platinum and iridium.

14. A process in accordance with claim 1 wherein the Group VIII metal in the catalyst composition comprises platinum and rhodium.

15. A process for upgrading a petroelum fraction which comprises contacting low octane reformate under reforming conditions with a base-exchanged shape-selective crystalline zeolite catalyst composition; wherein said catalyst is a zeolite having a silica/alumina ratio of at least 12 and having a shape-selective functioning intrazeolitic Group VIII metal content between about 0.01-10 weight percent, and wherein said catalyst is prepared by a process which corprises (1) subjecting as-synthesized crystalline zeolite material having a silica/alumina ratio of at least 12 to calcination at a temperature between about 200°-600° C. for a period between about 1-48 hours; (2) contacting the calcined zeolite with an aqueous solution of Group VIII metal compound to exchange or sorb ionic Group VIII metal into the zeolite; (3) thermally treating the Group VIII metal -containing zeolite at a temperature in the range between about 150°-550° C.; and (4) base-exchanging the zeolite substrate with Group IA metal cations to lower or essentially eliminate the base-exchangable acidic content of the catalyst composition.

16. A process in accordance with claim 15 wherein the catalyst exhibits substantially no acid-catalyzed reactivity.

17. A process for the production of aromatic hydrocarbons which comprises contacting $C_6$-$C_{50}$ hydrocarbons feedstock under reforming conditions with a base-exchanged shape-selective crystalline zeolite catalyst composition; wherein said catalyst is a zeolite having constraint index between about 1 and about 12, having a silica/alumina ratio of greater than 500/1 and having a shape-selective functioning intrazeolitic Group VIII metal content between about 0.01-10 weight percent, and wherein said catalyst is prepared by a process which comprises (1) subjecting as-synthesized crystalline zeolite material having a silica/alumina ratio of greater than 500/1 to calcination at a temperature between about 200°-600° C. for a period between about 1-48 hours; (2) contacting the calcined zeolite with an aqueous solution of Group VIII metal compound to exchange or sob ionic Group VIII metal into the zeolite; (3) thermally treating the Group VIII metal-containing zeolite at a temperature in the range between about 150°-550° C.; and (4) base-exchanging the zeolite substrate with Group IA metal cations to lower or essentially eliminate the base-exchangable acidic content of the catalyst composition.

18. The process according to claim 17, further comprising said zeolite being a ZSM-5 zeolite having a silica/alumina ratio of greater than 10,000/1.

19. The process according to claim 17 further comprising said zeolite being a ZSM-11 zeolite having a silica/alumina ratio of greater than 10,000/1.

20. The process according to claim 1, further comprising said zeolite having a constraint index between about 1 and about 12.

21. The process according to claim 15, further comprising said zeolite having a constraint index between about 1 and about 12.

22. The process according to claim 21, further comprising said zeolites being ZSM-5 zeolite, ZSM-11 zeolite, ZSM-12 zeolite, ZSM-35 zeolite or ZSM-38 zeolite.

23. The process according to claim 21, further comprising said zeolites being ZSM-5 zeolite, ZSM-11 zeolite, ZSM-12 zeolite, ZSM-35 zeolite or ZSM-38 zeolite.

* * * * *

UNITED STATES PATENT AND TRADEMARK OFFICE

CERTIFICATE OF CORRECTION

PATENT NO. : 4,652,360

DATED : March 24, 1987

INVENTOR(S) : Ralph M. Dessau

It is certified that error appears in the above-identified patent and that said Letters Patent is hereby corrected as shown below:

Col. 3, line 30, "assynthesized" should be -- as-synthesized--
Col. 14, Claim 1, line 59, "compositions" should be --composition--
Col. 15, Claim 1, line 5, "bae" should be --base--
Col. 15, Claim 15, line 1, "petroelum" should be --petroleum--
Col. 16, Claim 17, line 21, insert --a-- before "constraint"
Col. 16, Claim 17, line 32, "sob" should be --sorb--
Col. 16, Claim 22, line 1, "21" should be --20--

Signed and Sealed this

Eighteenth Day of August, 1987

*Attest:*

DONALD J. QUIGG

*Attesting Officer*

*Commissioner of Patents and Trademarks*